US005211418A

United States Patent [19]

Scherübl

[11] Patent Number: 5,211,418

[45] Date of Patent: May 18, 1993

[54] PLATE-SHAPED DAMPING DEVICE FOR SKI BINDING

[75] Inventor: Franz Scherübl, Radstadt, Austria

[73] Assignee: Varpat Patentverwertungs AG, Littau, Switzerland

[21] Appl. No.: 740,624

[22] Filed: Aug. 5, 1991

[30] Foreign Application Priority Data

Aug. 7, 1990 [AT] Austria ..... A 1661/90

[51] Int. Cl.[5] ..... A63C 5/07

[52] U.S. Cl. ..... 280/618; 188/381; 267/149; 267/158; 280/602; 280/607

[58] Field of Search ..... 280/601, 602, 607, 617, 280/618; 267/149, 158, 160; 188/381

[56] References Cited

U.S. PATENT DOCUMENTS

| | | | |
|---|---|---|---|
| 2,545,209 | 3/1951 | Meehan | 280/601 |
| 3,831,956 | 8/1974 | Earl | 280/617 |
| 5,083,809 | 1/1992 | Stampacchia et al. | 280/607 |

FOREIGN PATENT DOCUMENTS

| | | | |
|---|---|---|---|
| 235180 | 8/1964 | Austria | 280/601 |
| 0104185 | 5/1987 | European Pat. Off. . | |
| 2246668 | 4/1974 | Fed. Rep. of Germany | 280/617 |

*Primary Examiner*—Eric D. Culbreth
*Attorney, Agent, or Firm*—Collard & Roe

[57] ABSTRACT

A damping device is arranged between a surface of a ski and a binding holding a ski boot on the ski surface. The binding has a toe clamping member and a heel clamping member supported on a surface of a respective support portion. The damping device has a respective damping plate having an extension projecting from each support portion, the damping plate extensions extending towards each other in the same plane and having facing end faces defining therebetween at least a small gap. The damping plate extensions overlap in the direction of the longitudinal extension of the ski and are freely displaceable relative to each other in this direction.

37 Claims, 7 Drawing Sheets

II
II
1
2
3
4
5
6
7
8
9
10
11
12
13
26
27
28
29
30
51

1
9
12
13
14
15
16
17
18
19
20
21
22
23
24
25
26

PLATE-SHAPED DAMPING DEVICE FOR SKI BINDING

BACKGROUND OF THE INVENTION

1. Field of the Invention

The present invention relates to a plate-shaped damping device for a ski binding arranged between the ski binding and a surface of the ski. The ski binding comprises toe and heel clamping members for holding a ski boot on the ski.

2. Description of the Prior Art

European patent No. 104,185 discloses such a damping device, which is comprised of two parts and consists of a metallic plate and an elastic layer arranged between the metal plate and the ski surface. The ski binding is fastened to the metallic plate whose ends are movably connected to the ski surface by a respective one of the elastic layers. This arrangement has the disadvantage that, due to the length of the ski binding, the mounting points of the elastic layers forming the damping device have a considerable distance from the center of the ski, which is the ideal mounting point. Therefore, to avoid an unfavorable effect on the vibration of the ski, the properties of the elastic layers must be very accurately tailored to the structural properties of the ski, which makes these damping devices very expensive.

SUMMARY OF THE INVENTION

It is the primary object of this invention to provide a plate-shaped damping device of the first-indicated type which enables the deformation movements of the ski to be damped or absorbed without completely blocking them.

The above and other objects are accomplished according to the invention with a damping device arranged between a surface of a ski and a binding holding a ski boot on the ski surface, the binding comprising a toe clamping member and a heel clamping member supported on a surface of a respective support portion for clamping the ski boot, the damping device comprising a respective damping element having an extension projecting from each one of the support portions, the damping element extensions extending in the same plane towards each other and having facing end faces defining therebetween at least a small gap. The end faces of the damping element extensions are preferably rounded.

This arrangement has the surprising advantage that the damping element extensions enable the oscillation properties of the ski between the fastening points of the ski binding to be influenced by a predetermined flexibility of their material. This makes it possible to prevent high-frequency oscillations due to high stresses, which improves the running properties of a ski equipped with such a damping device. The gap between the facing end faces of the damping elements, which may be a result of their rounded shape, has the additional advantage of preventing canting of the damping elements and a corresponding blocking of the free oscillatory movement when the ski oscillates from its straight zero position in a longitudinal plane extending in the direction of the longitudinal extension of the ski and perpendicularly to its surface. The arrangement also makes possible a ski which is freely displaceable in this direction with respect to the toe and/or the heel clamping member. This additionally avoids a disadvantageous influence on the oscillations of the ski.

The damping element extensions may overlap in the direction of the longitudinal extension of the ski, which eliminates a free distance between the damping elements and thus avoids the accumulation of ice and snow.

If one of the damping element extensions defines a recess receiving the other damping element extension, a deformation of the damping elements under strong stresses and lateral impacts will be avoided.

According to another preferred feature, the damping device comprises a guide arrangement for longitudinally guiding each damping element extension in the direction of the longitudinal extension of the ski. The guide arrangement has vertical abutment faces generating a counter-moment to any lateral torsion forces so that the damping device will also damp such forces.

According to one embodiment, the guide arrangement has a length corresponding to a maximum adjustment range of the distance between the toe and heel clamping members. This enables the damping elements to be adjusted in accordance with different distances between the toe and heel clamping members required for different ski boot sizes.

The damping elements are preferably comprised of a flexible material having spring-back resiliency, which makes it possible to use commercially available, relatively inexpensive material, particularly bar-shaped material, which will readily transmit the mounting forces of the toe and heel clamping members. The damping elements are preferably almost stiff in a direction extending perpendicularly to the ski surface, i.e. substantially resistance to flexure.

Damping elements comprised of a synthetic resin, particularly a synthetic resin foam material, such as a polyurethane, polyvinyl chloride or polyester foam, have favorable damping properties while retaining sufficient rigidity or stiffness.

According to another preferred embodiment, the damping elements are deformable in a longitudinal plane extending in the longitudinal direction of the ski and perpendicularly to the ski surface at least in the range of the extensions thereof. In this way, the extensions operate as cantilevered damping arms increasingly counteracting any further deformation of the ski as the ski becomes deformed during a bending or flexure thereof. This very simply damps oscillations and deformation movements of the ski.

The preferred thickness of the damping elements is 5 mm to 20 mm, preferably 10 mm. In this way, the support plane of the ski boot is elevated from the ski surface by the substantial thickness of the damping elements, which enables the edges of skis equipped with such a damping device to enclose a steeper angle with the running surface of the ski without an edge of the sole of the ski boot, which normally is wider than the ski, touching the running surface. Skis with such a damping device are, therefore, advantageously used in steep downhill races.

The damping elements are preferably substantially rigid or stiff adjacent the extensions thereof. This enables the damping effect to be changed between the extensions and the adjacent portions of the damping elements.

If the damping element extensions have spring-back resiliency and are deformable in all directions, a variety of oscillations, including compound oscillations, may be smoothly damped.

According to a further feature of the present invention, the damping elements are leaf springs clamped respectively between the toe and heel clamping members and the ski surface. This enables the damping properties to be changed simply by a corresponding adjustment of the leaf spring.

If each damping element comprises a preferably stiff reinforcing element, the damping properties of the damping device may be adjusted over a wide range, independently of the nature of the damping element material. Preferably, the reinforcing element is replaceably arranged in the damping element to make it possible to change the damping properties rapidly to adapt to a variety of skiing condition. The reinforcing element may be a resilient metal or synthetic resin element. The reinforcing element may be comprised of a spatial lattice framework embedded in the damping element, for example by being injection molded therein. This will enable the reinforcing element to be fit and integrated in the damping element simply by placing the reinforcing element in a mold and injection-mold a synthetic resin foam therearound to form the reinforced damping element. If the reinforcing element is arranged at least in the extension and is elastically deformable in a direction extending perpendicularly to the ski surface, the snap-back effect of the extension may be simply and rapidly adapted to different skiing conditions. Preferably, the reinforcing element has a higher resistance to pressure than the damping element and forms a spacing element in a support portion of the damping element. This provides a highly resistant and strong support for the ski binding in the area where it is fastened to the surface of the ski while the flexibility of the damping device may be freely selected. The reinforcing element defines bores for receiving fastening elements for the toe and heel clamping members of the ski binding.

If the damping elements define bores for receiving fastening elements for the toe and heel clamping members, they may be associated with a specific ski binding without danger of a mix-up.

According to yet another embodiment, the damping device further comprises support plates for at least one of the clamping members, a respective support plate being arranged between the ski surface and the damping element, and the damping element and the one clamping member. Spacers preferably interconnect the support plates, the spacers having a length approximating the thickness of the damping element. This prevents a point stress on the damping device in the areas where the ski binding is fastened to the ski surface.

According to another embodiment, the damping device comprises a further damping element arranged between the facing end faces of the damping elements to enhance the damping effect.

The damping elements are preferably comprised of a material of predeterminable elasticity and have a circumference substantially corresponding to the circumference of the ski binding. This will avoid projections unfavorably influencing the safety of skis equipped with such damping devices so that the ski will have not only better damping properties but also enhanced streamlining.

According to yet another preferred embodiment, at least one of the damping elements is comprised of a plate spaced from the ski surface and damping members projecting from the plate towards the ski surface. In this way, the damping effect desired to resist deformations of the ski and to absorb impacts directed against the ski boot and to prevent them from reaching the ski can be readily fine-tuned by varying the thickness of the damping element plate and the arrangement and structure of the damping members projecting therefrom. If the plate and the damping members are of different materials, the inherent differences in the damping properties of these materials will make it possible to impart different damping characteristics to the device along the length of the ski. If desired, the plate and the damping members are injection molded in a multi-material injection molding process to form an integral damping element.

Preferably, the material of the damping members has better oscillation-damping properties than the material of the plate, which makes it possible to impart a better damping effect to those zones where the major weight of the skier rests on the damping device.

If the damping members define cavities between the plate and the ski surface, damping movements perpendicularly to the ski surface may be imparted to the plate.

According to a preferred feature, the damping members comprise webs extending along the circumferential edges of the plate. This will prevent the penetration of foreign bodies, such as snow or sludge, in the space between the ski surface and the plate, which would interfere with the damping effect.

If the damping members further comprise additional damping members within the cavities defined by the webs, the damping effect may be further varied along different areas of the damping element plate. The additional damping members may comprise webs and annular support members. If at least some of the additional damping members have a height smaller than that of the webs, the areas of movement causing deformation of the plate, in which there is no damping of the movement and in which damping of the movement begins, can be predetermined.

If the webs have at least partly a zig-zag or sinuous form, the resistance to deformation may be additionally reduced in certain areas of the damping web.

Preferably, the damping device further comprises a guide arrangement between the clamping members for longitudinally guiding each damping element extension in the direction of the longitudinal extension of the ski, the guide arrangement including mating guide faces in overlapping portions of the damping element extensions. This will dependably prevent jamming of the damping device at extreme deformations of the ski.

BRIEF DESCRIPTION OF THE DRAWING

The above and other objects, advantages and features of this invention will become more apparent from the following detailed description of certain now preferred embodiments, taken in conjunction with the accompanying, partly schematic, drawing wherein.

DETAILED DESCRIPTION OF PREFERRED EMBODIMENTS

Figure 1:
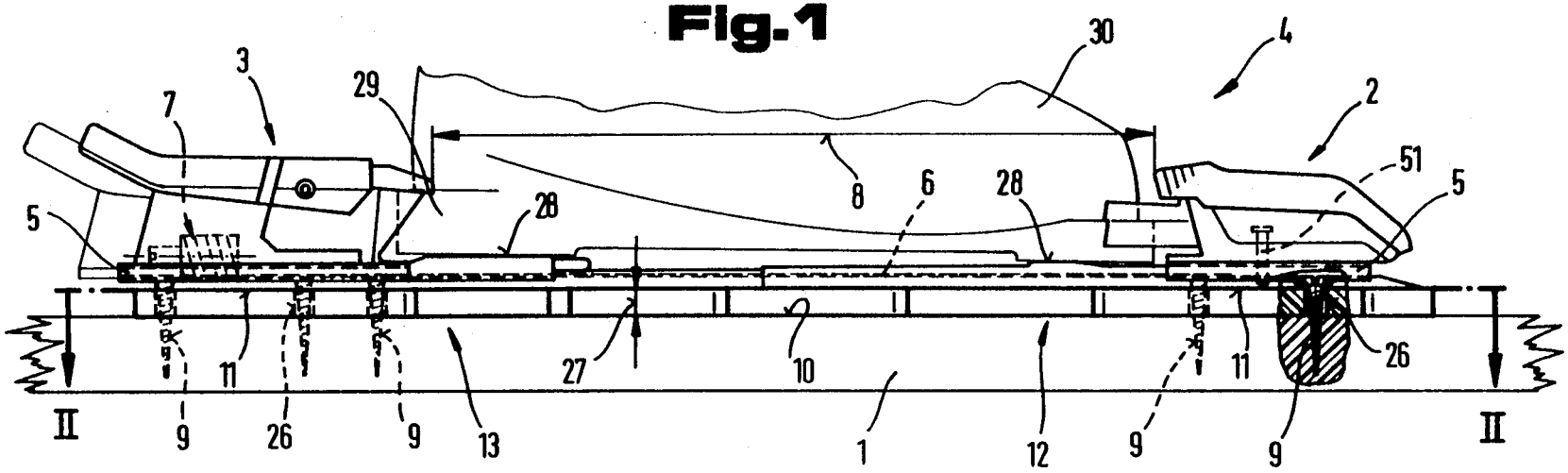
FIG. 1 is a fragmentary and simplified side view of a ski equipped with a ski binding and damping device according to one embodiment of the invention.
Figure 2:
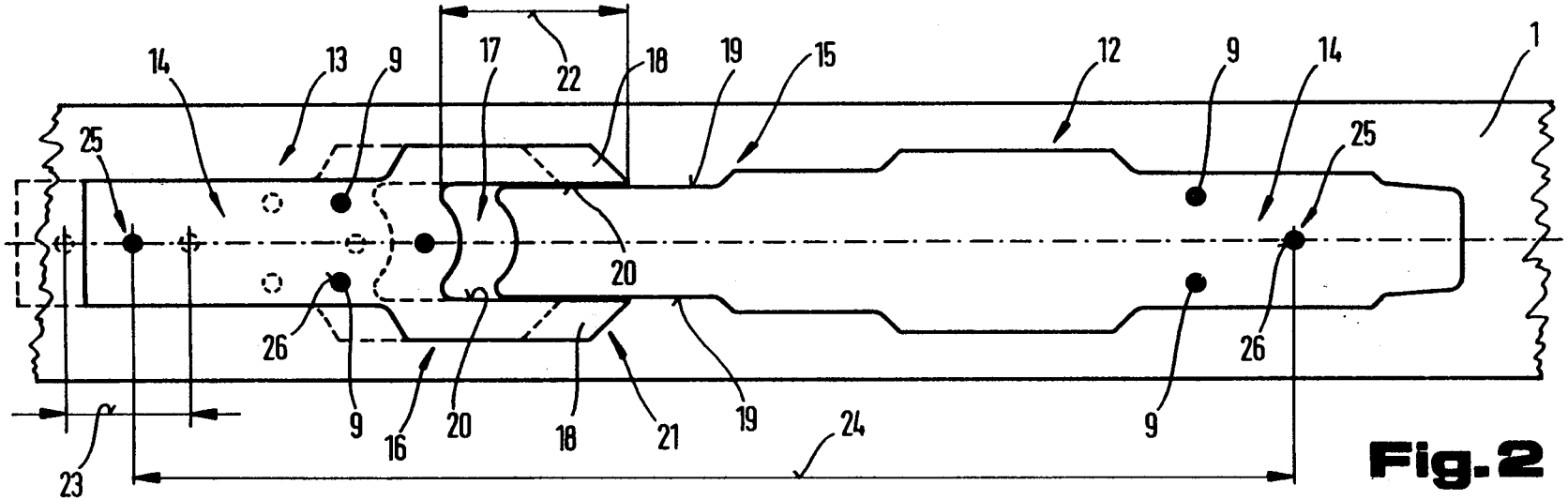
FIG. 2 is a top view taken along line II—II of FIG. 1, showing the damping device.

Referring now to the drawing, like reference numerals designate like parts operating in a like manner in all figures, and it should be noted that the sizes of some parts are illustrated out of proportion to aid in an understanding of the invention. Referring first to FIGS. 1 and 2, there is shown a damping device 12, 13 arranged between surface 10 of ski 1 and binding 4 holding ski boot 30 on ski surface 10. The binding comprises toe clamping member 2 and heel clamping member 3 supported on the surface of respective support portion 11 for clamping the ski boot. In the illustrated embodiment, the toe and heel clamping members are displaceable in a direction extending in the longitudinal extension of ski 1 in longitudinal guides 5. Band 6 extends between, and connects, the toe and heel clamping members, and adjustment device 7 enables the clamping members to be held at a pre-selected distance 8. Longitudinal guides 5 of toe and heel clamping members 2, 3 of ski binding 4 are fastened to ski 1 by fastening elements, i.e. screws, 9. During use, toe clamping member 2 is fixed in longitudinal guide 5 against displacement by stop pin 51 while heel clamping member 3 remains longitudinally displaceable in its guide 5 and is held at the desired distance by band 6. In this way, the ski is freely movable with respect to the heel clamping member and the deformation of the ski is not hindered by ski binding 4.

Figure 5:
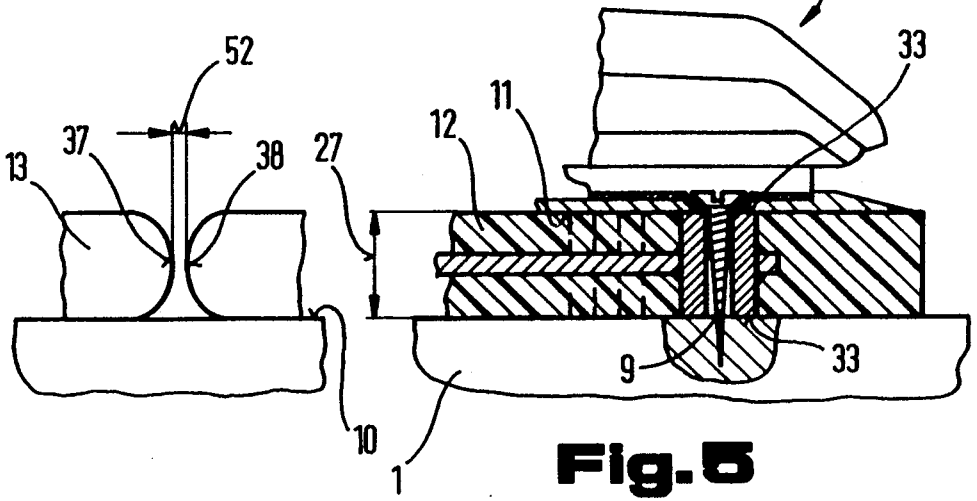
FIG. 5 is a like fragmentary section taken along line V—V of FIG. 3, showing yet another embodiment of the damping device.

The damping device comprises a respective damping element 12, 13 having extension 15, 16 projecting from each surface portion 11, support portion 14 of each damping element being respectively associated with toe clamping member 2 and heel clamping member 3. Damping element extensions 15, 16 extend towards each other in the same plane and have facing end faces 37, 38 defining therebetween at least a small gap 52 (see FIG. 5). This gap must be maintained even when the ski binding has been adjusted to the smallest boot size. As shown in FIG. 5, end faces 37, 38 of damping element extensions 12, 13 are rounded, in which case the end faces may almost touch when the damping elements are coplanar. The gap is provided to prevent jamming of the end faces during a flexing of ski 1 if the end faces are formed by sharp edges. If they are rounded, however, such jamming will be prevented by the gaps defined by arcuate portions of the rounded end faces.

As shown in FIG. 2, the damping element extensions overlap each other in the direction of the longitudinal extension of the ski 1. Damping element extension 16 is fork-shaped at its free end, prongs 18 extending parallel to the longitudinal extension of the ski and defining recess 17 receiving the other damping element extension 15. Edges 19 of extension 15 overlap prongs 18 of extension 16 and abutment faces 20 of prongs 18 cooperate with edges 19 to constitute a longitudinal guide arrangement 21 for longitudinally guiding each damping element extension in the direction of the longitudinal extension of the ski for free displacement relative to each other in this direction. Abutment faces 20 of guide arrangement 21 are high enough to provide not only a longitudinal guidance of damping element extensions 15, 16 but also guide the extensions in a direction extending perpendicularly to ski surface 1. This makes it possible to increase the counter-force exerted by extensions 15, 16 against the deformation of ski 1 even at relatively small ski deformations. The prongs and their abutment faces 20, which form guide arrangement 21, have a length 22 corresponding to a maximum adjustment range 23 of distance 24 between fastening points 25 of toe and heel clamping members 2, 3, or rather of longitudinal guides 5 supporting the toe and heel clamping members.

Damping elements 12, 13 have a thickness 27 (see FIG. 5) of 5 mm to 20 mm, preferably 10 mm. They define bores 26 for receiving fastening elements 9 with which guides 5 for the toe and heel clamping members are attached to ski 1. Bores 26 may have a larger diameter than screws 9 so that the longitudinal guides for clamping members 2, 3 may be affixed to the ski without exerting a stress on damping elements 12, 13.

The damping elements are preferably comprised of a flexible material having spring-back resiliency, such as a suitable synthetic resin material. They may be made of a synthetic resin foam, such as a polyurethane foam sheet or any other synthetic resin of sufficient strength and elastic properties. The damping elements may also consist of multiply plates or sheets, the resultant sandwich structure being comprised of different materials, including rubber or like elastic layers. The damping elements may be so constructed that they may absorb relatively high pressures in the area of fastening elements 9 without being deformed by such stresses, i.e. they are substantially rigid adjacent the extensions thereof. The projecting extensions of the damping elements should be almost stiff in a direction extending perpendicularly to the ski surface so that they function as cantilevered rods when ski 1 is deformed perpendicularly to its surface 10. Since damping elements 12, 13 are clamped between ski surface 10 and toe and heel clamping members 2, 3, extensions 15, 16 project rectilinearly towards each other. When ski 1 is flexed between toe and heel clamping members 2, 3 due to pressure in the direction of its running surface, the longitudinal gap between damping elements 12, 13 permits a longitudinal compensation because of the different flexure arc lengths of ski 1 and of damping elements 12, 3 but their extensions 15, 16 counter-act the deformation of the ski with a force corresponding to the flexure resistance of the damping elements. In this way, thickness 27 of damping elements 12, 13 may be so selected that the damping elements will generate a resistance to a deformation of the ski in a direction extending perpendicularly to ski surface 10 which increases with an increase in the ski deformation.

The damping device of the present invention will particularly damp high-frequency oscillations of ski 1 between toe and heel clamping members 2, 3. In addition, damping elements 12, 13 may be comprised of a material of predeterminable elasticity which is so selected that oscillations transmitted from ski 1 through contact surfaces 28 and soles 29 of ski boot 30 to a skier in a direction extending perpendicularly to ski surface 10 are also damped to the selected extent. In this manner, the damping device permits skiing substantially free of oscillations and vibrations, which enhances the comfort as well as the safety of the skier. With a suitable dimensioning of adjustment range 23, the damping device may be adapted to varying ski boot sizes so that it may be used with conventional ski bindings which are adjustable to different shoe sizes.

Figure 3:
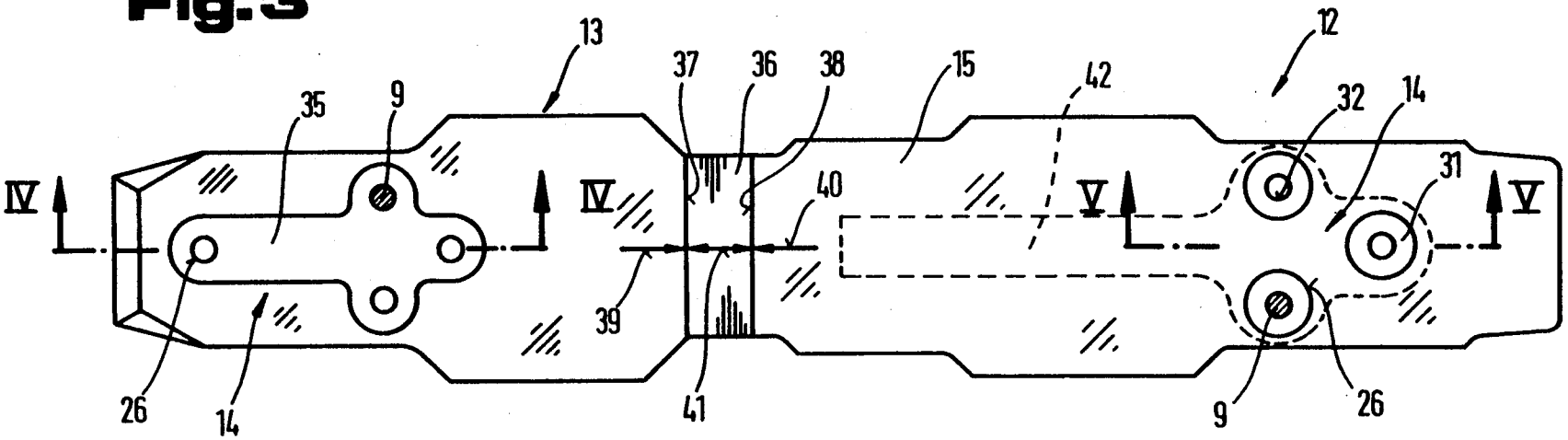
FIG. 3 is a top view of another embodiment of the damping device.
Figure 4:
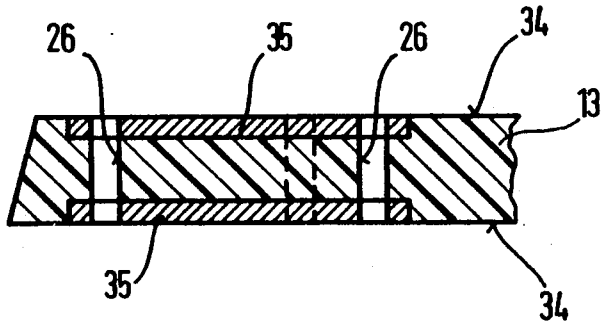
FIG. 4 is a fragmentary section along line IV—IV of FIG. 3.

FIGS. 3 to 5 illustrate an embodiment of the damping device incorporating some optional features of this invention. As shown, sleeve-shaped spacers 31 are provided in damping element 12 in support and fastening area 14 of toe clamping member 2, the length of the spacers being equal to, or slightly exceeding, thickness 27 of damping element 12. Spacers 31 are introduced into bores 26 in the damping element and have bores 32 receiving fastening elements 9 attaching the longitudinal guide for toe clamping member 2 to ski 1. In this way, the clamping forces exerted by fastening screws 9 between ski surface 10 and mounting face 11 of the clamping member guide are transmitted by end faces 33 of spacers 31 to the spacers so that the toe clamping member will be securely fastened to the ski. The use of such fastening stress absorbing spacers permits the damping element to be constructed so that it has the optimal mechanical properties for damping ski oscillations, without regard to its pressure-resistant properties. Spacers 31 may be of hard polyvinylchloride, metal or other suitable rigid material. If desired, they may have circumferentially arranged anchoring elements, such as screw threads or radial projections, to anchor them in the damping element.

As shown in FIG. 4, support plates 35 for heel clamping member 3 of ski binding 4 may be arranged between the ski surface damping element 13, and the damping element and the heel clamping member in support area 14, the damping element defining recesses in surfaces 34 of the damping element for receiving support plates 35. The support plates define bores 26 for fastening elements 9 and, like spacers 31, they may be of hard polyvinylchloride, metal or other suitable rigid material. They serve to distribute the stresses on the damping elements in the support area 14 uniformly. It is also possible to fasten the clamping member or its longitudinal guide by screws 9 only to facing support plate 35 in one damping element surface 34 while support plate 35 in the opposite surface 34, which faces ski surface 10, is fastened to the ski. In this way, impact and vibratory forces exerted upon ski boot 30 by ski 1 may be damped by the damping elements.

As shown in FIG. 3, the damping device may comprise further damping element 36 arranged in the gap between facing end faces 37, 38 of damping elements 12, 13. If gap 52 between the end faces at the maximum compression of further damping element 36 is long enough to correspond to the reduction of the distance between the end faces at the maximum ski deformation, the further damping element will avoid blocking the free movement of the ski when it passes over a depression. When ski 1 is flexed, pressure forces will be exerted in the directions of arrows 39, 40 to cause end faces 37, 38 to press against further damping element 36 whereby the further damping element is compressed, building up a counterforce in the compressible damping element 36, which acts against a further movement of end faces 37, 38 towards each other. This counter-force may be suitably varied by selecting the material and elastic or damping properties of the compressible damping element. Intermediate damping element 36 in gap 52 may be omitted altogether but this may hinder the functioning of the damping device, due to ice and snow accumulations between end faces 37, 38.

As further shown in FIGS. 3 and 5, the damping element may comprise stiff reinforcing plate element 42 which may be replaceably arranged in the damping element. The reinforcing element may be embedded in the damping element centrally between opposite surfaces 34 of the damping element (see FIG. 5) and is movable with spacers 31 to which it is attached. The resistance to deformation and the snap-back force of the damping element extension exerted upon the flexed ski can be varied by a suitable selection of the material of reinforcing plate element 42, which projects into the extension, and/or of spacers 31.

Figure 6:
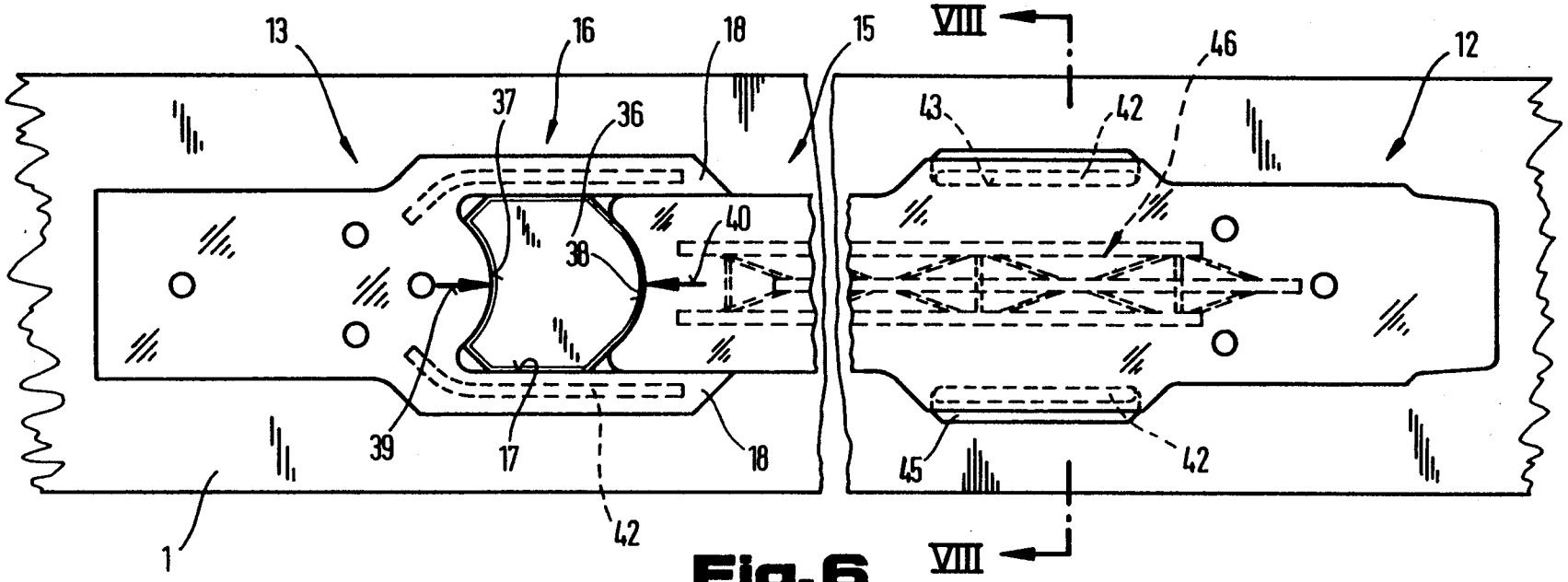
FIG. 6 is a fragmentary top view of still another embodiment of the damping device.
Figure 7:
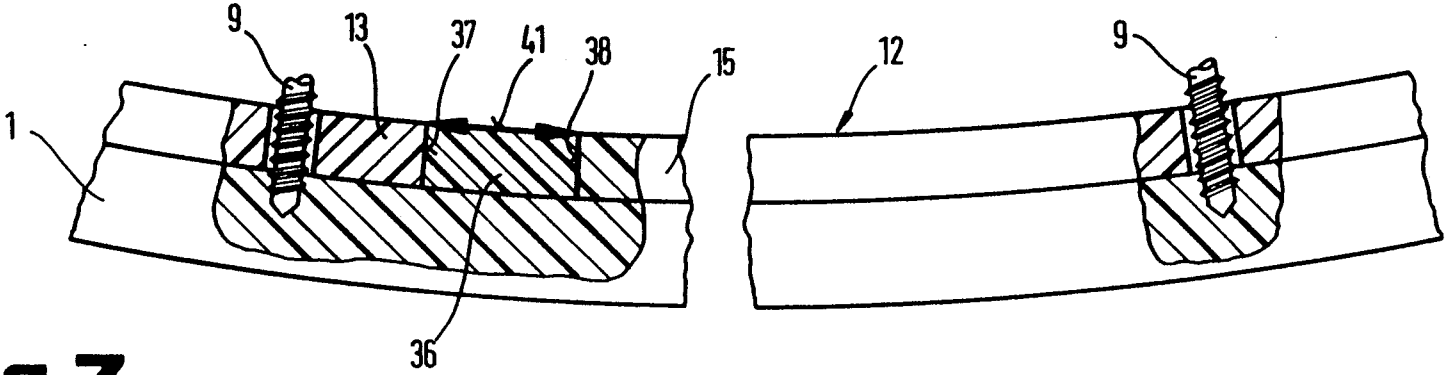
FIG. 7 is a side view of the damping device of FIG. 6, partly in section.
Figure 8:
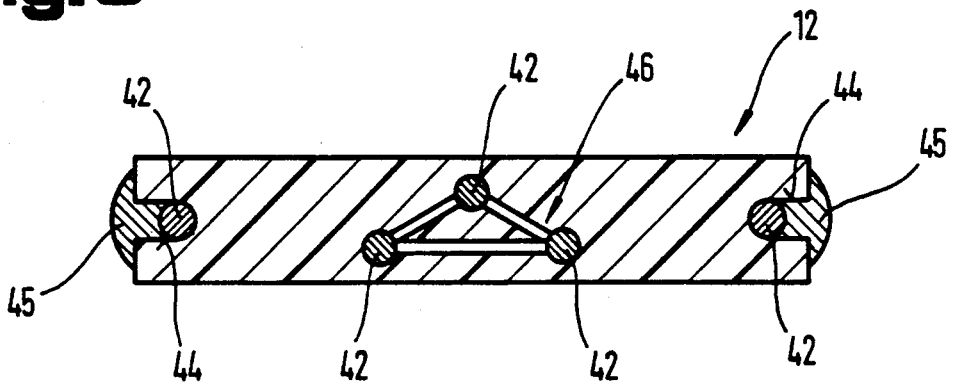
FIG. 8 is a sectional end view of the damping device of FIG. 6, taken along line VIII—VIII.

FIGS. 6 to 8 also show an embodiment of the clamping device wherein damping element extensions 15 and 16 overlap, prongs 18 at the free end of extension 16 defining recess 17 receiving the free end of extension 15 and compressible damping element 36 being arranged in the gap between end faces 37, 38 of extensions 15, 16 and being engaged thereby. The arrangement functions in the same manner as described hereinabove in connection with FIG. 3. In this embodiment, the damping properties of damping elements 12, 13 are also controlled by incorporating reinforcing elements 42 in extensions 15, 16 of the damping elements but these reinforcing elements are arranged in elongated recesses 43 along the sides of damping element extension 15, which are defined by grooves 44 extending in the direction of the longitudinal extension of ski 1, and are embedded in the damping element. If the damping element is comprised of a synthetic resin foam, the reinforcing elements may be embedded therein during the foaming and shaping process. Reinforcing elements 42 may be replaceably mounted in grooves 44 (see also FIG. 8) and they may be protected against the penetration of dirt and/or snow and ice by placing closure profiles 45 thereover. As illustrated, embedded reinforcing elements 42 may comprise spatial lattice framework 46, which produces a good three-dimensional transmission of flexing and torsion forces into the material of the damping element. The reinforcing elements are arranged at least in the extension of the damping elements and are elastically deformable in a direction extending perpendicularly to the ski surface. They have a higher resistance to pressure than the damping element and form a spacing element in support portion 14 of the damping elements.

Damping elements 12, 13 may have different mechanical properties along their length, i.e. in the direction of the longitudinal extension of ski 1, which enables the damping device to be adapted to various conditions of use and makes it a multi-purpose device. For example, the damping elements may be deformable in a longitudinal plane extending in the longitudinal direction of the ski and perpendicularly to the ski surface at least in the range of the extensions thereof. The damping element extensions may have spring-back resiliency and be deformable in all directions. The damping elements may be leaf springs clamped respectively between the toe and heel clamping members 2, 3 and ski surface 10.

Figure 9:
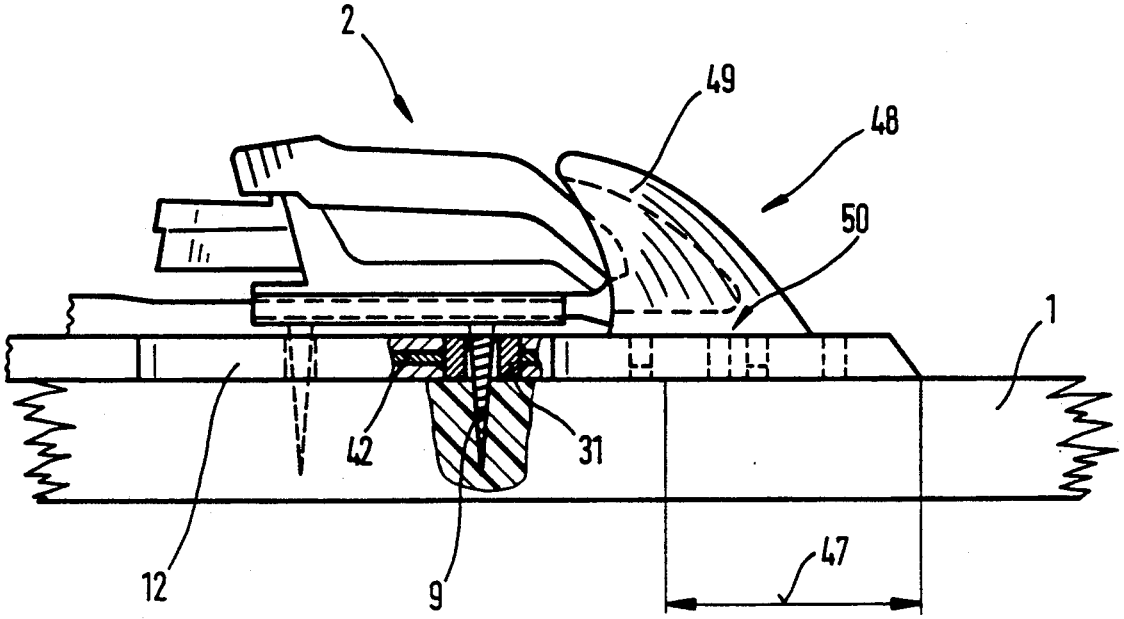
FIG. 9 is a fragmentary side view, partly in section, of a special embodiment.

FIG. 9 shows an embodiment wherein damping element 12 is forwardly extended by length 47 towards the point of ski 1 for holding streamlining arrangement 48. This arrangement is constituted by streamlined body 49 mounted ahead of toe clamping member 2 and detachably connected to damping element 12 by plugs 50 or like detachable connecting elements so that body 49 may be readily plugged in during skiing and rapidly removed when a manipulation of clamping member 2 is required. Streamlined body 49 is cost-effectively made of synthetic resin. Such a streamlining arrangement selectively combined with the damping device makes it possible to reduce the CW-value in the range of ski binding 4. If desired, streamlined body 49 may be integral with damping element 12.

As shown, reinforcing element 42 is integral with spacers 31 and defines bores for receiving fastening elements 9 for the clamping members.

Figure 10:
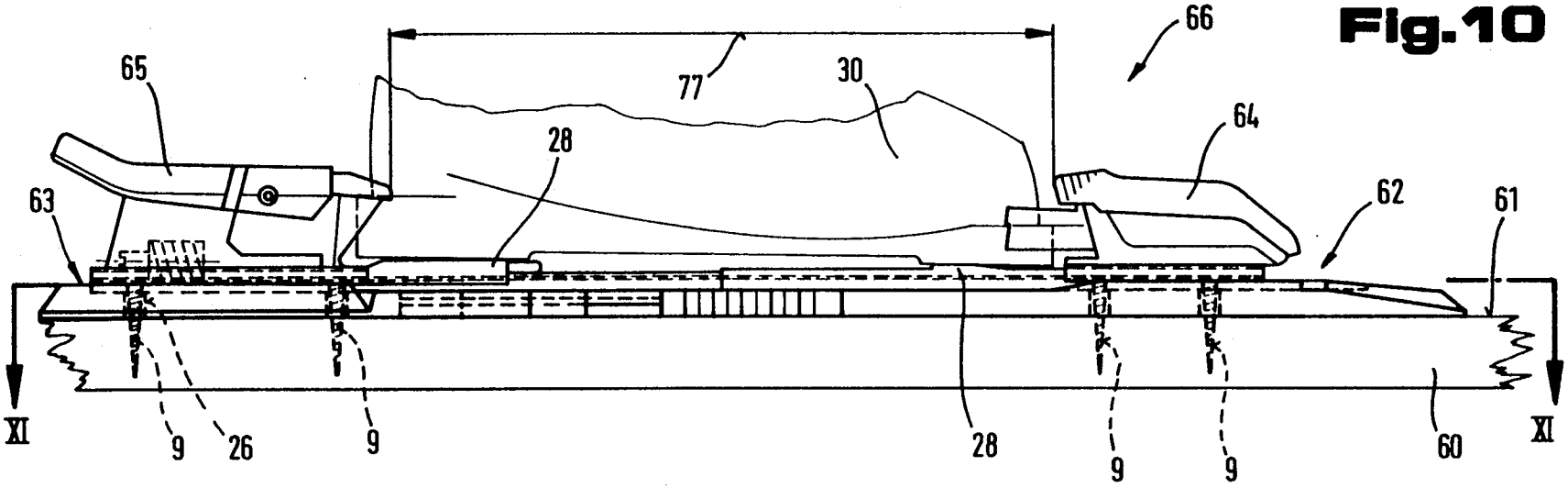
FIG. 10 is a fragmentary and simplified side view of a ski equipped with a ski binding and damping device according to yet another embodiment of the invention.
Figure 11:
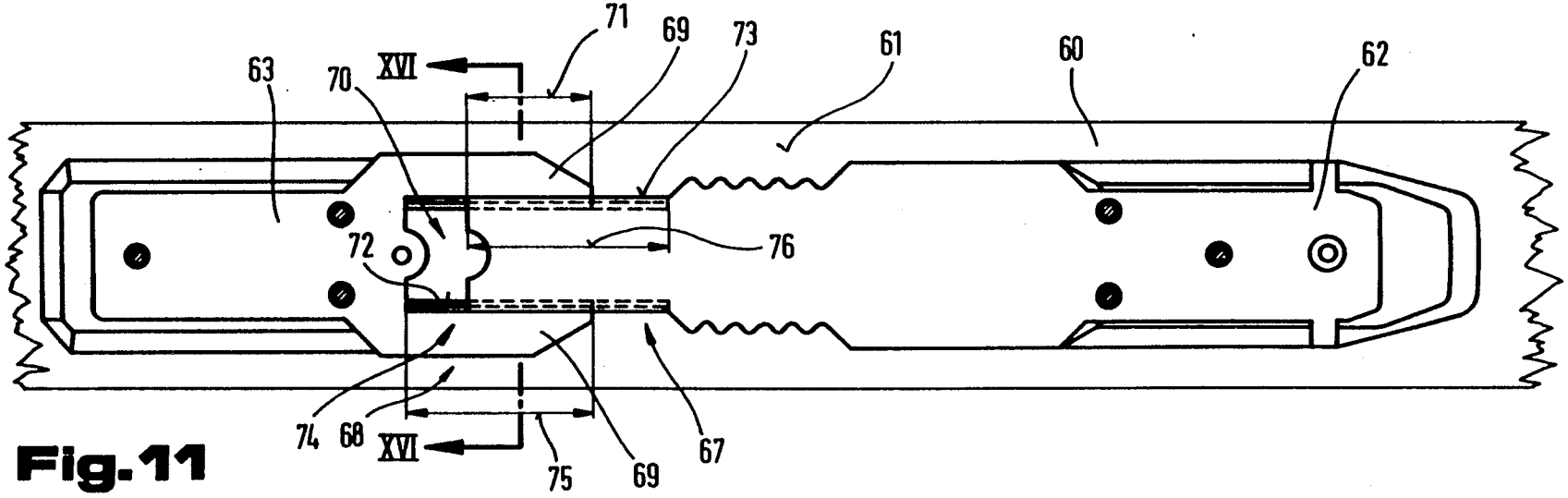
FIG. 11 is a top view taken along line XI—XI of FIG. 10, showing the damping device.

FIGS. 10 and 11 show ski 60 and ski binding 66 comprised of toe clamping member 64 and heel clamping member 65 affixed to ski surface 61, with damping device 62, 63 clamped between the ski surface and binding. Damping elements 62, 63 have projecting extensions 67, 68 facing each other. Damping element extension 68 has fork-like prongs 69 extending towards toe clamping member 64, which define recess 70 therebetween and which recess receives damping element extension 67 extending towards heel clamping member 65. The two damping element extensions overlap over range 71 and side edges 72,73 of prongs 69 constitute longitudinal guide 74 for the damping elements. Length 75 of prongs 69 and length 76 of extension 67 enable the damping elements to be relatively adjusted along longitudinal guide 74. Distance 77 between clamping members 64 and 65 may be adjusted up to the sum of lengths 75 and 76 without creating a free space extending transversely to the longitudinal extension of the ski between damping elements 62 and 63.

Toe and heel clamping members 64, 65 are affixed to the ski by fastening screws 9 which pass through bores 26 in damping elements 62, 63. In this way, the weight of the skier is transmitted by the toe and heel clamping members to damping elements 62, 63 and is damped before it reaches ski 60. The damping elements also have gliding surfaces 28 supporting the sole of ski boot 30 whereby counter-deformations occurring particularly after strong deformations in the direction of the running surface of the ski, i.e. so-called negative flexing, are also damped, as well as impacts occurring when the skier jumps with ski 60 on a flat surface.

Figure 12:
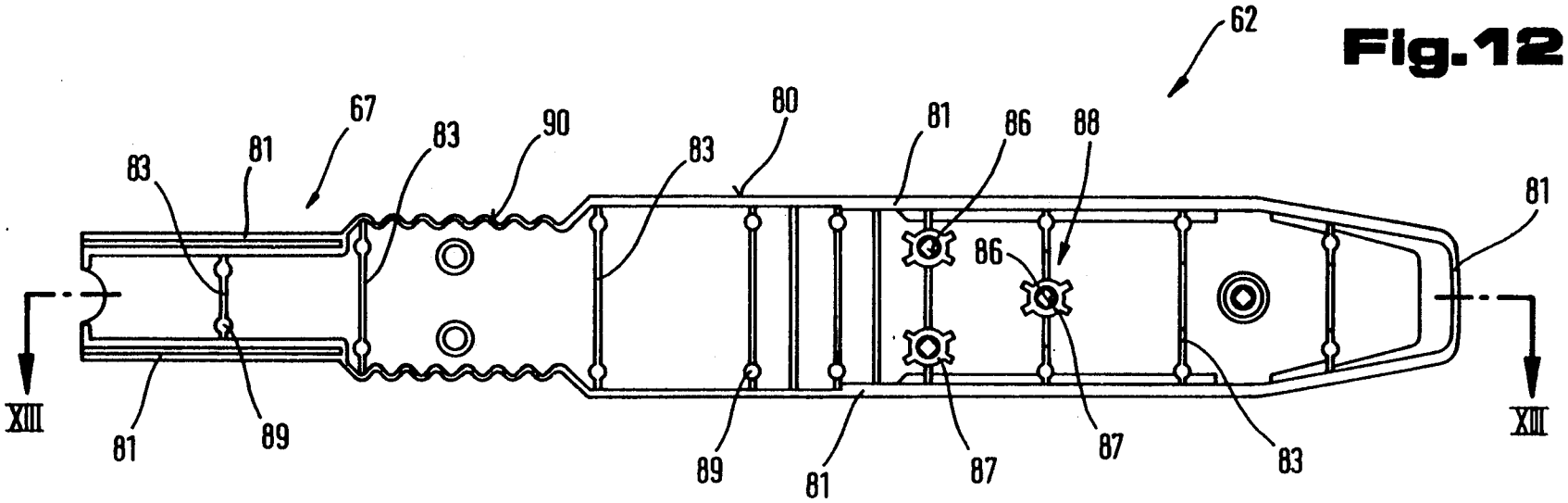
FIG. 12 is a bottom view of one of the damping elements of the damping device of FIG. 11.
Figure 13:
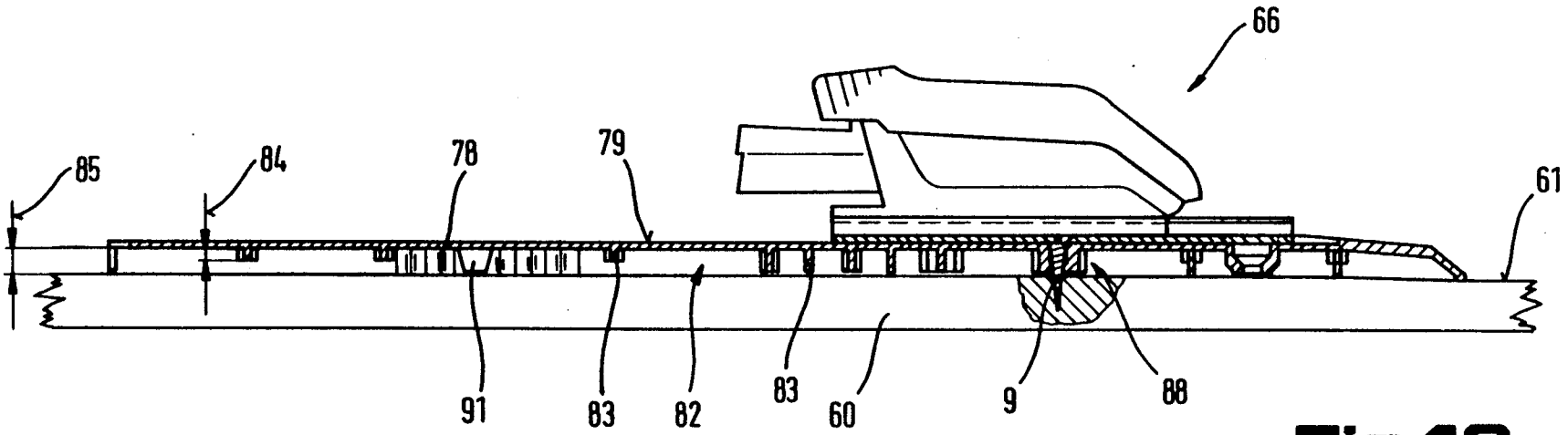
FIG. 13 is a section along line XIII—XIII of FIG. 12.
Figure 14:
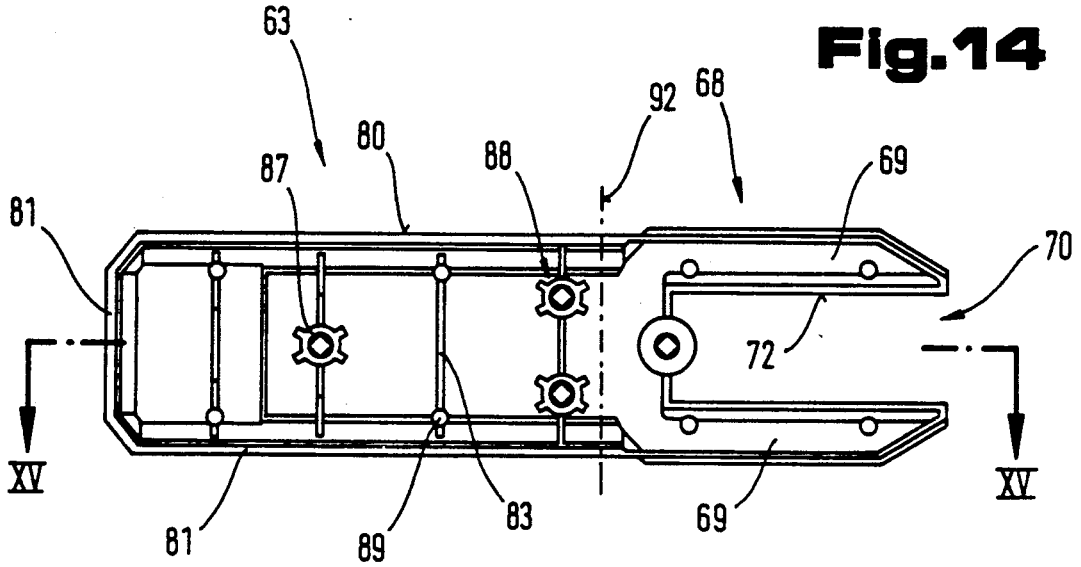
FIG. 14 is bottom view of the other damping element of the damping device of FIG. 11.
Figure 15:
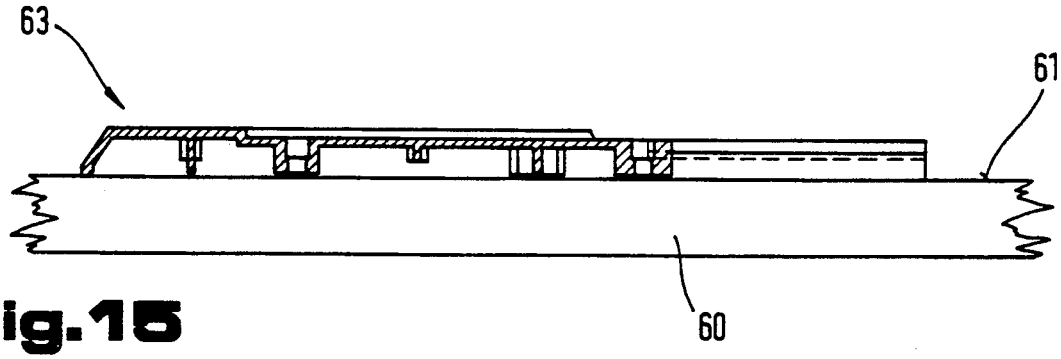
FIG. 15 is a section along line XV—XV of FIG. 14.

FIGS. 12 to 16 illustrate the damping elements in detail, FIGS. 12 and 14 showing, respectively, bottom views of damping elements 62 and 63. As shown, each damping element is comprised of plate 78 spaced from ski surface 61 and damping members 81, 83, 87 projecting from the plate towards the ski surface and capable of supporting damping element plate 78 on ski surface 61. The damping element plates extend substantially parallel to ski surface 61 and upper surface 79 of plates 78 supports toe and heel clamping members 64, 65 of ski binding 66. The damping members define cavities 82 between plate 78 and ski surface 61. In the illustrated embodiment, the damping members comprise webs 81 extending along circumferential edges 81 of the plate and additional damping members 83, 87 within cavities 82 defined by webs 81. Damping members 83 are webs extending transversely to the longitudinal extension of ski 60 and damping members 87 are annular support members. Transversely extending webs 83 have a height 84 smaller than that of circumferentially extending webs 81 and annular damping members 87, which also serve as spacers 88 between ski surface 61 and damping element plate 78. These annular damping members define bores in alignment with bores 86 in the damping element plate to receive fastening screws 9 affixing ski binding 66 to ski 60.

Damping members 81, 83, 87 may be strips, lattices, studs, in zig-zag form, as shown at 90, or in the shape of frusto-conical knobs, as shown at 91, it being possible to tune the different heights of the damping members so that the damping effect is gradually changed, for example in the direction of gliding surface 28 which substantially supports the weight of the skier.

The damping properties may be further fine-tuned by making plate 78 and damping members 81, 83, 87 of different materials. Thus, the plate and the damping members of damping elements 62, 63 may be injection molded in a multi-material injection molding process to form an integral damping element. For example, damping element extension 67 of damping element 62 and prongs 69 of damping element 63 may be made of a different, for instance stiffer, material than the rest of the damping elements, or the materials of the plate and damping members may have different damping properties, for example the material of the damping members may have better oscillation-damping properties than the material of the plate. The materials, preferably synthetic resin, for the components of the damping elements may be chosen according to desired flexibility and deformation properties thereof, suitable additives being incorporated in these materials to obtain the desired damping properties with respect to high-frequency oscillations, sudden impacts and deformations of the ski.

Any area along the length of damping elements 62, 63, such as the transition area schematically indicated by phantom line 92 in FIG. 14, may be so structured or of such a material as to change the deformation resistance in a manner to control the deformation resistance of damping element extensions 67, 68 which operate like bending-resistant rods.

Figure 16:
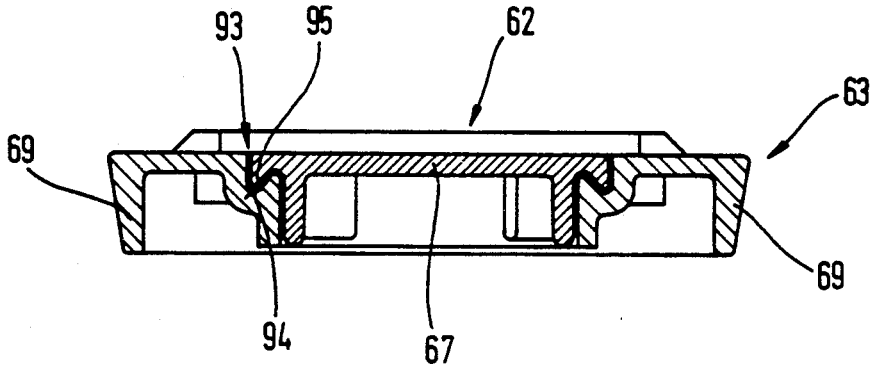
FIG. 16 is a section along line XVI—XVI of FIG. 11.

As shown in FIG. 16, the damping device further comprises guide arrangement 93 between clamping members 64, 65 for longitudinally guiding each damping element extension 67, 68 in the direction of the longitudinal extension of ski 60, the guide arrangement including mating and interlocking guide faces 94, 95 in overlapping portions of the damping element extensions. In the illustrated embodiment, guide face 94 defines a V-shaped groove receiving mating guide face 95. Thus, damping element extension 67 is engaged between prongs 69 of damping element extension 68 and guide arrangement 93 assures an exact lateral and vertical guidance for damping elements 62, 63. This prevents any jamming of the damping device when it damps a deformation of the ski.

In all embodiments, the damping elements preferably have a circumference substantially corresponding to the circumference of ski binding.

As mentioned hereinabove, the damping elements may be multi-ply sandwich plates comprised of different self-supporting layers, for instance of rubber, sheet metal, glassfiber reinforced synthetic resins or extruded synthetic resins, with an embedded core layer of any suitable, including waste, material, such as pressed boards, synthetic foams and others. Preferred are synthetic resin plates whose surfaces are more strongly reticulated during polymerization by a suitable temperature control so that these damping elements have a higher resistance to pressure.

What is claimed is:

1. A damping device arranged between a surface of a ski and a binding holding a ski boot on the ski surface, the binding comprising a toe clamping member and a heel clamping member supported on a surface of a respective support portion for clamping the ski boot, the damping device comprising a respective plate-shaped damping element having an extension projecting from each one of the support portions, the damping element extensions extending towards each other in the same plane, overlapping in the direction of the longitudinal extension of the ski, being freely displaceable relative to each other in this direction, and having facing end faces defining therebetween at least a small gap in the direction of the longitudinal extension of the ski.

2. The damping device of claim 1, wherein the end faces of the damping element extensions are rounded.

3. The damping device of claim 1, wherein one of the damping element extensions defines a recess receiving the other damping element extension.

4. The damping device of claim 1, further comprising a guide arrangement for longitudinally guiding each damping element extension in the direction of the longitudinal extension of the ski.

5. The damping device of claim 4, wherein the guide arrangement has a length corresponding to a maximum adjustment range of the distance between the toe and heel clamping members.

6. The damping device of claim 1, wherein the damping elements are comprised of a flexible material having springback resiliency.

7. The damping device of claim 6, wherein the material of the damping elements is almost stiff in a direction extending perpendicularly to the ski surface.

8. The damping device of claim 1, wherein the damping elements are comprised of a synthetic resin foam material.

9. The damping device of claim 1, wherein the damping elements are deformable at least in the range of the extensions thereof in a longitudinal plane extending in the direction of the longitudinal extension of the ski and perpendicularly to the ski surface.

10. The damping device of claim 1, wherein the damping elements have a thickness of 5 mm to 20 mm.

11. The damping device of claim 1, wherein the damping elements are substantially rigid adjacent the extensions thereof.

12. The damping device of claim 1, wherein the damping element extensions have spring-back resiliency and are deformable in all directions.

13. The damping device of claim 1, wherein the damping elements are leaf springs clamped respectively between the toe and heel clamping members and the ski surface portion.

14. The damping device of claim 1, wherein each damping element comprises a stiff reinforcing element.

15. The damping device of claim 14, wherein the reinforcing element is replaceably arranged in the damping element.

16. The damping device of claim 14, wherein the reinforcing element is comprised of a spatial lattice framework embedded in the damping element.

17. The damping device of claim 14, wherein the reinforcing element is arranged at least in the extension and is elastically deformable in a direction extending perpendicularly to the ski surface.

18. The damping device of claim 14, wherein the reinforcing element has a higher resistance to pressure than the damping element and forms a spacing element in a support portion of the damping element.

19. The damping device of claim 18, wherein the reinforcing element defines bores for receiving fastening elements for the toe and heel clamping members.

20. The damping device of claim 1, further comprising support plates for at least one of the clamping members, a respective support plate being arranged between the ski surface and the damping element, and the damping element and the one clamping member.

21. The damping device of claim 20, further comprising spacers interconnecting the support plates, the spacers having a length approximating the thickness of the damping element.

22. The damping device of claim 1, further comprising a further damping element arranged between the facing end faces of the damping elements.

23. The damping device of claim 1, wherein the damping elements are comprised of a material of predeterminable elasticity.

24. The damping device of claim 1, wherein the damping elements have a circumference substantially corresponding to the circumference of the ski binding.

25. The damping device of claim 1, wherein at least one of the damping elements is comprised of a plate spaced from the ski surface and damping members projecting from the plate towards, the ski surface.

26. The damping device of claim 25, wherein the plate and the damping members are of different materials.

27. The damping device of claim 26, wherein the plate and the damping members are injection molded in a multimaterial injection molding process to form an integral damping element.

28. The damping device of claim 26, wherein the materials of the plate and damping members have different damping properties.

29. The damping device of claim 28, wherein the material of the damping members has better oscillation-damping properties than the material of the plate.

30. The damping device of claim 25, wherein the damping members define cavities between the plate and the ski surface.

31. The damping device of claim 30, wherein the damping members comprise webs extending along the circumferential edges of the plate.

32. The damping device of claim 31, wherein the damping members further comprise additional damping members within the cavities defined by the webs.

33. The damping device of claim 32, wherein the additional damping members comprise webs and annular support members.

34. The damping device of claim 32, wherein at least some of the additional damping members have a height smaller than that of the webs.

35. The damping device of claim 31, wherein the webs have at least partly a zig-zag form.

36. The damping device of claim 1, further comprising a guide arrangement between the clamping members for longitudinally guiding each damping element extension in the direction of the longitudinal extension of the ski, the guide arrangement including mating guide faces in overlapping portions of the damping element extensions.

37. The damping device of claim 1, wherein the plate-shaped damping elements are spaced from the ski surface and comprise annular damping members serving as spacers between the ski surface and the damping elements, the damping elements and the annular damping members defining aligned bores for receiving fastening elements for the toe and heel clamping members.

* * * * *